US006422424B1

(12) United States Patent
Sheffler

(10) Patent No.: US 6,422,424 B1
(45) Date of Patent: Jul. 23, 2002

(54) DUAL-DISPENSING JAR

(75) Inventor: Robert J. Sheffler, Morganville, NJ (US)

(73) Assignee: Brad-Pak Enterprises, Incorporated, Garwood, NJ (US)

( * ) Notice: Subject to any disclaimer, the term of this patent is extended or adjusted under 35 U.S.C. 154(b) by 0 days.

(21) Appl. No.: 10/050,731

(22) Filed: Jan. 18, 2002

(51) Int. Cl.[7] ..... B67D 5/52
(52) U.S. Cl. ..... 222/138; 222/386
(58) Field of Search ..... 222/135–138, 222/251, 252, 319, 330, 386

(56) References Cited

U.S. PATENT DOCUMENTS 2,500,687 A * 3/1950 Kamp et al. ..... 222/138
3,760,985 A * 9/1973 Bryan ..... 222/136
5,720,416 A * 2/1998 Izoe ..... 222/138
5,890,627 A * 4/1999 Storey ..... 22/138

* cited by examiner

*Primary Examiner*—Lesley D. Morris
*Assistant Examiner*—Thach H. Bui
(74) *Attorney, Agent, or Firm*—Charles I. Brodsky

(57) ABSTRACT

A dispensing jar including an inner component forming a pair of chambers in which ingredients can be stored, and an actuating cover having a recessed well for receiving the ingredients dispensed into the well through a pair of orifices by imparted rotation of the cover, and with the cover having a pair of offset paddles downwardly extending into the chambers such that rotation of the actuating cover dispenses the ingredients from each chamber simultaneously up through the orifices into the well for admixture.

16 Claims, 6 Drawing Sheets

DUAL-DISPENSING JAR

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to a container for the dispensing of creams, pastes, and similar cosmetic products and, more particularly, to an improvement in the dispensing container described in U.S. Pat. No. 3,760,985.

2. Description of the Related Art

U.S. Pat. No. 3,760,985 describes a dispensing container having a pair of chambers containing cream or paste, along with a vane downwardly extending from its cover. Rotation of the cover in a clockwise direction forces the contents of one of the chambers out through a first orifice; rotation of the cover in a counterclockwise direction forces the contents of the other chamber out through a second orifice. A fixed partition divides the container into the two chambers, with the first dispensing orifice being disposed in the cover at one side of the vane, and with the second dispensing orifice being disposed in the cover at the vane's opposite side. The vane downwardly depends from the cover in a plane substantially perpendicular to the cover, which constitutes a closure for the container. In this manner, a cream or paste product can be dispensed into a recessed well in the cover from one chamber, and once exhausted, can then be dispensed into the well from the other chamber.

SUMMARY OF THE INVENTION

The present invention follows a realization that some cosmetic products require a mixture of ingredients which undesirably tend to break down if the components are allowed to coexist together for an extended period of time. This can follow with certain vitamins for example. There, the various ingredients need to be kept separate until they are ready to be mixed and then dispensed.

Thus, and as will become clear from the following description, a preferred embodiment of the present invention comprises a dual-dispensing jar having a fixed partition disposed in a vertical plane like the prior construction to form a pair of chambers for the different ingredients. But instead of having a single rotatable vane depending from its cover, a pair of separated vanes (in the nature of blades) is employed, entirely disposed in one or the other chamber. Rotation of the cover then simultaneously forces both stored ingredients up into a recessed well through orifices provided in the actuating cover, instead of one-at-a-time.

As further contrasted with the earlier design, the two orifices are situated opposite one another in the cover, rather than adjacent; also, they are slightly offset one from another. This is to achieve a substantially complete exhaustion of the cosmetic ingredients from the chambers. To effectuate this, the two separate blades are also slightly offset from one another to attain the evacuation desired.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
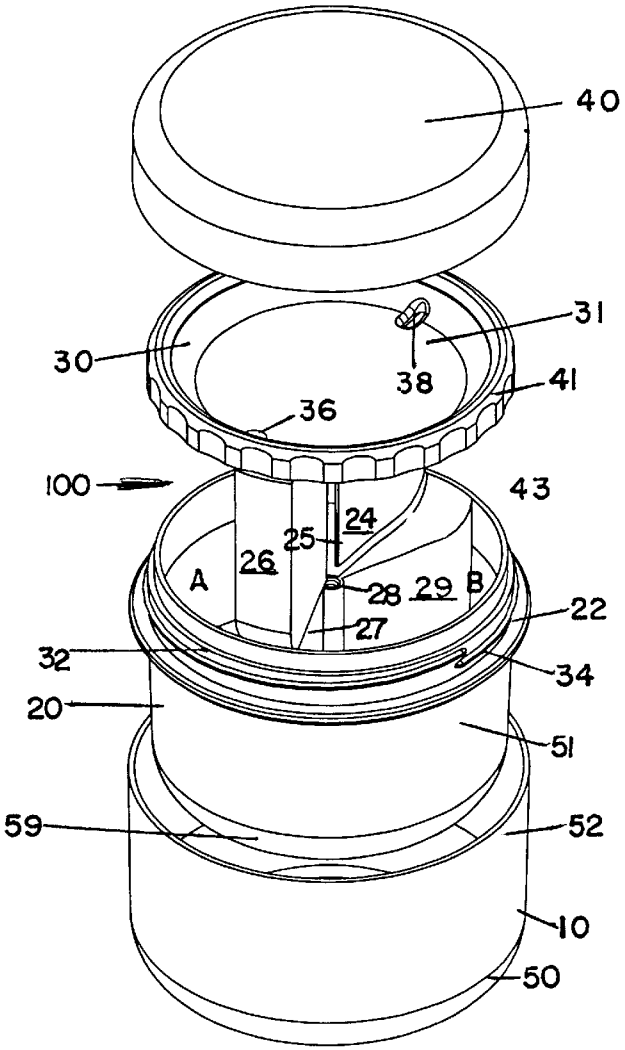
FIG. 1 is an exploded view of the individual components of the dual-dispensing jar of the invention in alignment for assembly.

Referring to FIG. 1, the dual-dispensing jar 100 includes an outer jar 10 which receives an inner jar 20 by a force or snap fit, with a circumscribing external rim 22. A double dispensing paddle 30, having a pair of separated vanes or blades 24, 26, fits within the inner jar 20 as a cover. The separation 25 extends along its length to align with a socket 28 in establishing the two sections 27, 29 as a fixed, rotatable partition within the inner jar 20. The double dispensing paddle 30 also includes a recessed product well 31 in its top surface, and a pair of orifices 36 and 38 which extend from its edges, opposite one another with a slight angular offset between them. As will be appreciated, the blades 24, 26 of the paddle 30 fit within the chambers A, B of the inner jar 20 formed by the partition of the sections 27, 29; an outer extension 41 of the double dispensing paddle 30 rests on a rim 43 of the inner jar 20. Lastly, a closure 40 extends over the rim 41 of the paddle 30, to screw together with a pair of mating threads 32, 34 on the inner jar 20 in sealing the dual-dispensing jar 100.

Figure 2:
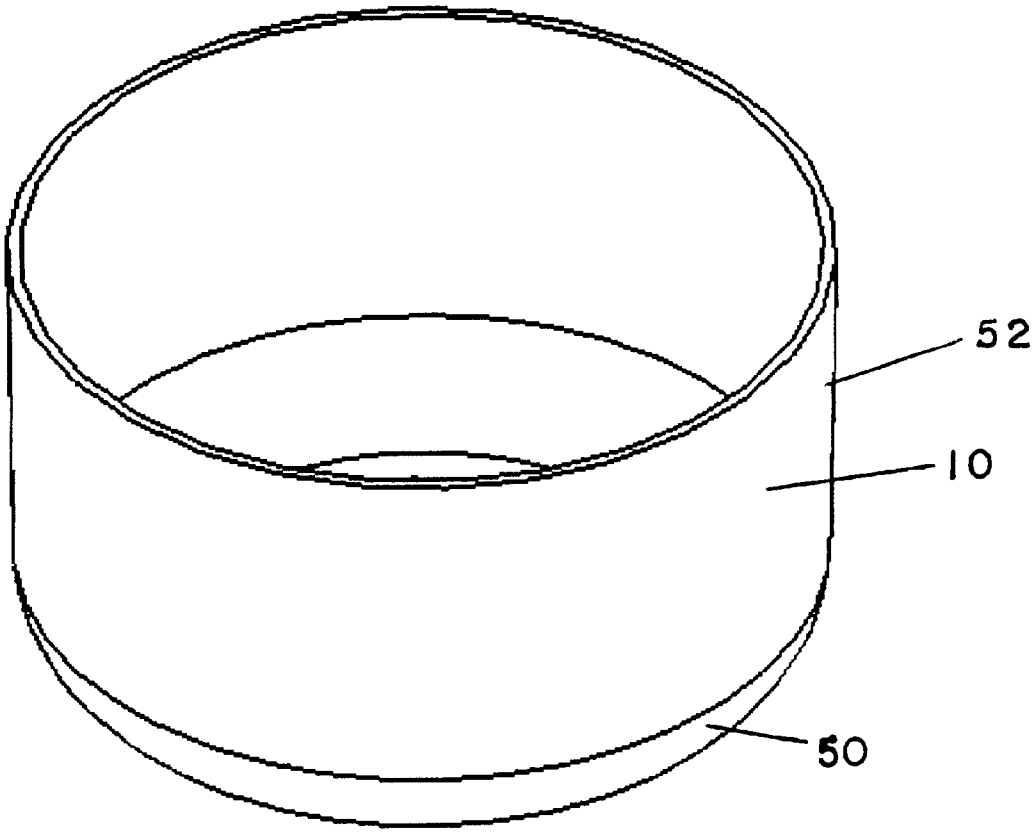
FIG. 2 is a top perspective view of an outer jar component of the dual-dispensing jar of FIG. 1.
Figure 3:
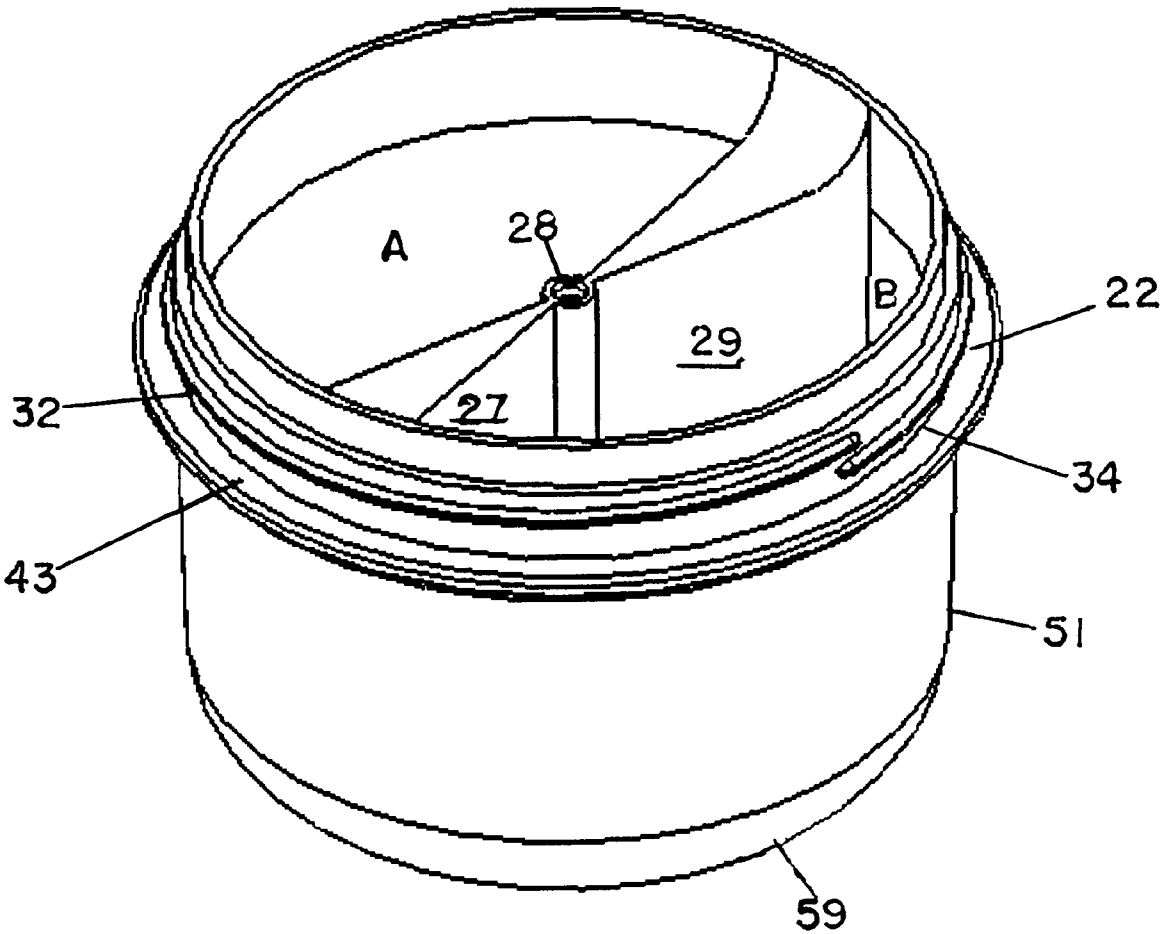
FIG. 3 is a top perspective view of an inner jar component of the dual-dispensing jar.

As illustrated in FIG. 2, the outer jar 10 merely serves as a base for the dual-dispensing jar 100, and includes a transverse bottom wall 50. An annular upright side wall 51 of the inner jar 20 (FIG. 3) fits within an annular side wall 52 of the outer jar 10 (FIG. 2). Ingredients to be mixed and/or dispensed are contained within the two chambers A, B of the inner jar 20, upon its own transverse bottom wall 59 (FIG. 3).

Figure 4A:
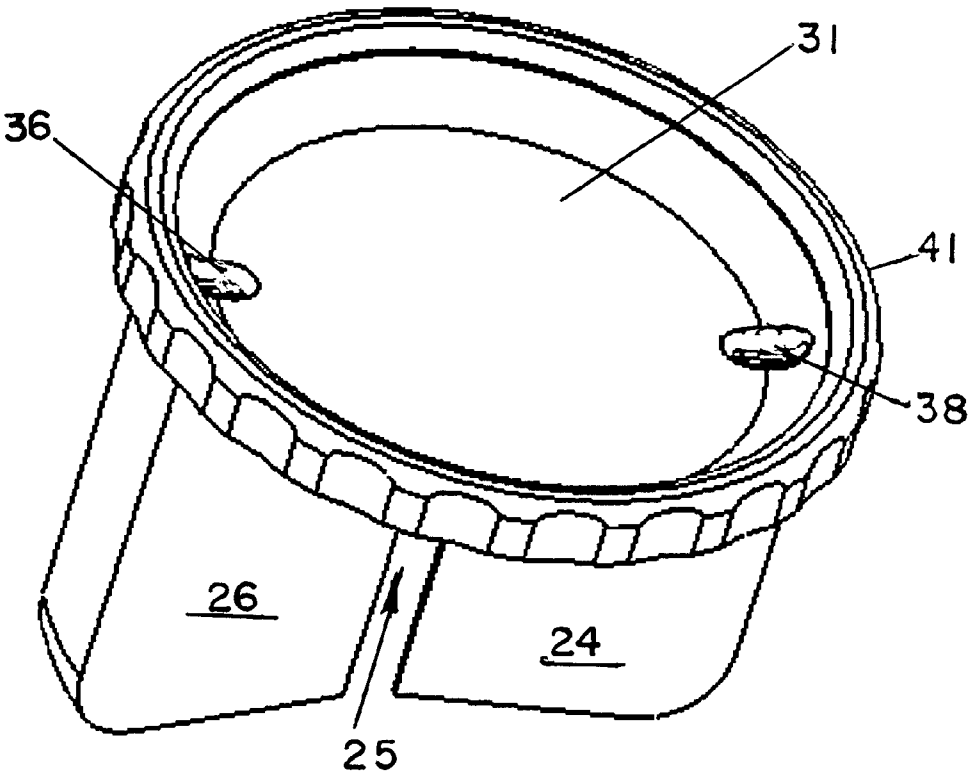
FIGS. 4*a* and 4*b* are top and bottom views, respectively, of the double dispensing blade component of the dual-dispensing jar which fits within the two chambers of the inner jar component.
Figure 4B:
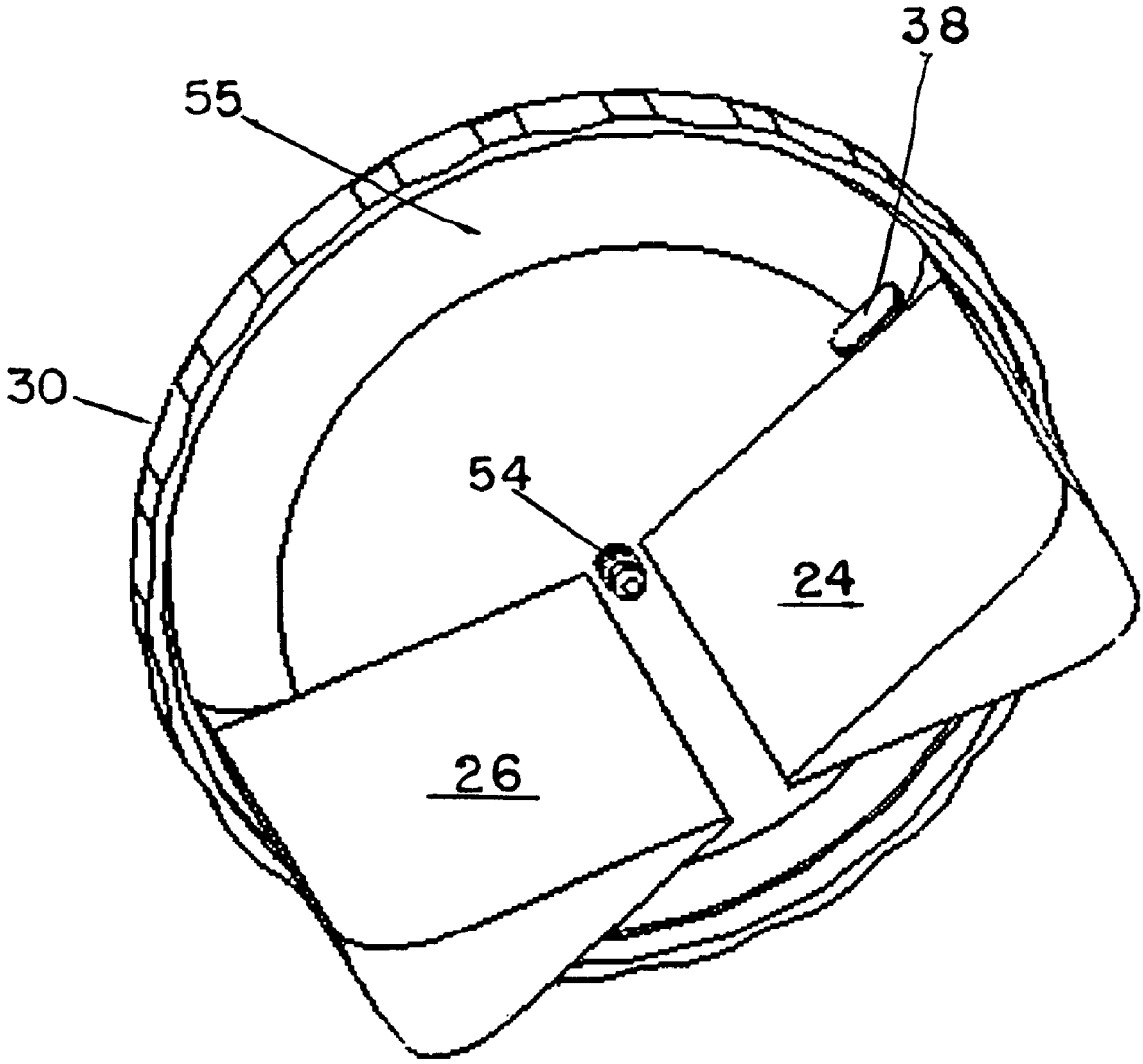
Figure 5:
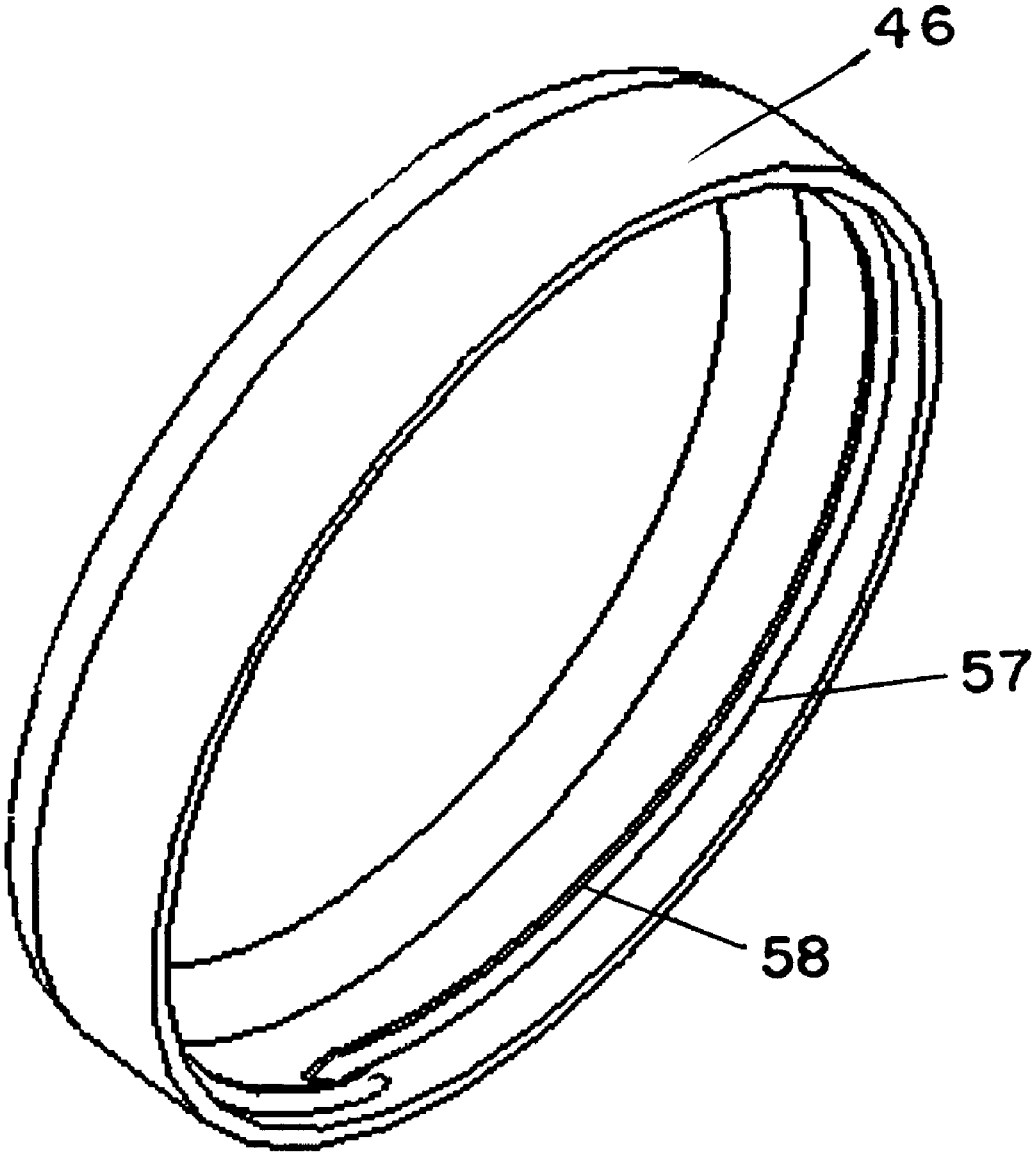
FIGS. 5 is a bottom perspective view of the closure which seals the dual-dispensing jar when not in use.

FIGS. 4*a* and 4*b* illustrate the separated vanes or blades 24, 26 extending from the underside of the double dispensing disk-like paddle along with the separation 25 between the blades. At the remote end of the separation, a rod or pin 54 extends from the underside of the paddle 30 to fit with the socket 28 of the inner jar 20 as a pivot, and in securing the inner jar 20 and double dispensing paddle 30 together. As indicated, the blades 24, 26 extend radially outward from the center to the side wall 51 and engage with the bottom wall 59. FIGS. 4*a* and 4*b* also illustrate an offset angular alignment between the blades 24, 26—preferably equal to the angular offset between the orifices 36, 38. FIG. 4*a* further shows the recessed well 31, the opposing dispensing orifices 36, 38 as being obliquely directed inwardly toward the well 31, and the rim 41 over which the removable closure 40 of FIG. 5 extends as a cap to join with the threads 32, 34 of the inner jar 20 by threads 57, 58. This effectively forms a seal by its liner engaging with the upper edge portion of the jar 20.

As with the dispensing container of U.S. Pat. No. 3,760,985, the individual components of the dispensing jar of the present invention can each be molded as separate plastic pieces for easy assembly. Also, each of the chambers of the inner jar 20 can be individually filled with the ingredients to be dispensed before its actuating cover is put into position. Additionally, rotating the actuating cover dispenses the contents up through its associated orifice.

However, with the dispensing container of U.S. Pat. No. 3,760,985, the dispensing is sequential in that rotation of the actuating cover clockwise only dispenses the ingredients of one of its two chambers—a counterclockwise rotation is then required to dispense the ingredients of the other chamber. With it, either the cream, paste, lotion or other ingredients of the first or the second chamber is dispensed through an orifice into the well, depending upon the rotation imparted.

With the teachings of the present invention, on the other hand, a dual-dispensing jar becomes available—one in which rotation of the paddle 30 in one direction simultaneously dispenses the contents of both its two chambers through their respective orifices into the recessed well at the same time. As will be appreciated, this follows from the use of the double paddle or blade arrangement 24, 26, and the separation therebetween. Turning the paddle 30 in one direction rotates the blades 24, 26 to slidably engage both the inner surfaces of the annular side wall 51 and the transverse bottom wall 59 for each chamber at the same time. For employment in those instances where a mixing of different ingredients is required—but where the ingredients cannot exist mixed together over long periods of time—this becomes particularly desirable. And, as will also be appreciated, by offsetting the two blades 24, 26 and the two orifices 36, 38 at substantially equal angular displacements (and with each orifice at an edge of the blade opposite the other), the two chambers can be effectively emptied together at the same rate; as well as wholly emptied, an otherwise limitation if the dual-dispensing concept were employed with the two blades and orifices being collinear. Additionally, and just from an ease of assembly, having the pivot at the top, on the underside of the paddle 30, represents an improvement over the construction of the U.S. Pat. No. 3,760,985 container where the pivot is at a lower internal location.

While there has been described what is considered to be a preferred embodiment of the present invention, it will be readily appreciated by those skilled in the art that modifications can be made without departing from the teachings herein. For example, the double-blade paddle operation will be seen as available even if the outer jar 10 were eliminated, and the removable cap 40 modified to secure at the upper edge of the inner jar 20; or the angular offsets between the blades and orifice be different; or the orifices not be obliquely downwardly directed toward the recessed well—although all of these are preferable in a completed construction. For at least such reason, therefore, resort should be had to the claims appended hereto for a true understanding of the scope of the invention.

I claim:

1. A dispensing jar comprising:

a dispensing section having an annular upright side wall portion and a transverse bottom wall portion;

a fixed partition disposed within said dispensing section in a vertical plane, extending radially from the center of said dispensing section to the side wall portion thereof and engaged with the transverse bottom wall portion of said dispensing section, said partition being adapted to define first and second chambers in said dispensing section;

an actuator of disk-like configuration constituting a cover for said dispensing section;

means turnably mounting said actuator on said dispensing section to enable rotation with respect thereto;

a double-bladed vane including first and second blades rigidly carried by and depending from said actuator and disposed in a plane substantially perpendicular thereto, with each of said first and second blades slidably engaging an inner surface of said annular side wall portion of said dispensing section and slidably engaging said transverse bottom wall portion thereof, in each of said first and second chambers, and with said first and second blades being spaced apart to receive a pivot defined by a pin and socket extending therebetween;

with said actuator cover having a first dispensing orifice disposed at one edge communicating with one of said chambers and having a second dispensing orifice disposed on an opposite edge communicating with the other of said chambers;

whereby the contents of one chamber are dispensed through said first orifice and the contents of said other chamber are dispensed through said second orifice simultaneously as said actuator cover is rotated with respect to said dispensing section.

2. The dispensing jar of claim 1 wherein said first and second blades of said vane are offset at an angle with respect to one another.

3. The dispensing jar of claim 1 wherein said first orifice is situated on one side of said first blade and said second orifice is situated on an opposite side of said second blade.

4. The dispensing jar of claim 3 wherein said first and second orifices are offset at an angle with respect to one another.

5. The dispensing jar of claim 2 wherein said first orifice is situated on one side of said first blade and said second orifice is situated on an opposite side of said second blade, wherein said first and second orifices are offset at an angle with respect to one another, and wherein said angular offset of said first and second blades and said angular offset of said first and second orifices are substantially equal.

6. The dispensing jar of claim 1 wherein said pin downwardly extends from the center of said actuator cover and said socket upwardly extends from said transverse bottom wall portion.

7. The dispensing jar of claim 1, also including a removable closure cap constituting a seal for said dispensing section, said cap overlying said actuator cover, and including a sealing liner engageable with an upper edge portion of said dispensing section.

8. The dispensing jar of claim 4 wherein said dispensing section includes an outwardly extending surrounding rim, and wherein there is additionally included an outer base section having a second annular upright side wall portion and a second transverse bottom wall portion upon which said surrounding rim rests when inserting said dispensing section within said outer base section.

9. The dispensing jar of claim 1 wherein said actuating cover includes a recessed product well extending in the top surface thereof between said first and second orifices.

10. The dispensing jar of claim 9 wherein said first and second orifices are obliquely directed inwardly toward said recessed product well.

11. The dispensing jar of claim 1, additionally including a first content in one chamber different from a second content in said other chamber.

12. A dispensing jar comprising:

a dispensing section having a first annular upright side wall portion and a first transverse bottom wall portion;

an outer base section having a second annular upright side wall portion and a second transverse bottom wall portion;

a surrounding rim outwardly extending from said first annular upright side wall portion of said dispensing section resting on said second annular upright side wall portion of said outer base section;

a fixed partition disposed within said dispensing section in a vertical plane, extending radially from the center of said dispensing section to said first annular upright side wall portion thereof and engaged with said first transverse bottom wall portion of said dispensing section in defining first and second chambers in said dispensing section;

a first ingredient content in said first chamber different from a second ingredient content in said second chamber;

an actuator of disk-like configuration constituting a cover for said dispensing section;

a removable closure cap constituting a seal for said dispensing jar, said cap overlying said actuating cover and including a sealing liner engageable with an upper edge portion of said outer base section;

a double-bladed vane including first and second blades rigidly carrier by and depending from said actuator cover and disposed in a plane substantially perpendicular thereto, with each of said first and second blades slidably engaging an inner surface of said first annular side wall portion of said dispensing section and slidably engaging said first transverse bottom wall portion of said dispensing section in only one of said first and second chambers;

with said first and second blades being spaced apart to receive a pivot defined by a pin and socket extending therebetween; and with said actuating cover having a first dispensing orifice disposed at one edge communicating with one of said chambers and having a second dispensing orifice disposed on an opposite edge communicating with the other of said chambers;

whereby the contents of one chamber are dispensed through said first orifice and the contents of said other chamber are dispensed through said second orifice simultaneously as said actuator cover is rotated with respect to said dispensing section.

13. The dispensing jar of claim 12 wherein said first and second blades of said vane are offset at an angle with respect to one another.

14. The dispensing jar of claim 12 wherein said first orifice is situated on one side of said first blade and said second orifice is situated on an opposite side of said second blade.

15. The dispensing jar of claim 14 wherein said first and second orifices are offset at an angle with respect to one another.

16. The dispensing jar of claim 13 wherein said first orifice is situated on one side of said first blade and said second orifice is situated on an opposite side of said second blade, wherein said first and second orifices are offset at an angle with respect to one another, and wherein said angular offset of said first and second blades and said angular offset of said first and second orifices are substantially equal.

* * * * *